US011006208B1

(12) United States Patent
Ruffa

(10) Patent No.: US 11,006,208 B1
(45) Date of Patent: May 11, 2021

(54) COMPACT LOW-FREQUENCY ACOUSTIC SOURCE

(71) Applicant: The United States of America as represented by the Secretary of the Navy, Newport, RI (US)

(72) Inventor: Anthony A Ruffa, Hope Valley, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/722,387

(22) Filed: Dec. 20, 2019

(51) Int. Cl.
*H04R 1/22* (2006.01)
*H04R 1/02* (2006.01)
*H04R 1/28* (2006.01)

(52) U.S. Cl.
CPC ..... *H04R 1/227* (2013.01); *H04R 1/025* (2013.01); *H04R 1/2803* (2013.01); *H04R 2201/405* (2013.01); *H04R 2430/23* (2013.01)

(58) Field of Classification Search
CPC ..... H04R 9/18; H04R 17/10; H04R 23/02; H04R 2201/02; H04R 2201/405; H04R 2430/20; H04R 2430/23; H04R 1/44; H04R 1/028; H04R 1/20; F03G 3/06
See application file for complete search history.

(56) References Cited

U.S. PATENT DOCUMENTS 3,388,218 A * 6/1968 Hurvitz ..... H04R 1/20 381/62
5,136,201 A * 8/1992 Culp ..... B25J 5/00 310/328
2017/0236547 A1* 8/2017 Baggio ..... G11B 20/10527 381/26
2020/0343799 A1* 10/2020 Bai ..... H02K 21/029

OTHER PUBLICATIONS

Amherst, "Classical" Minimalism, published Apr. 2019, https://web.archive.org/web/20190422223426/https://www.amherst.edu/media/view/313298/original/Taruskin%2Bon%2BReich.pdf (Year: 2019).*
Wikipedia, Microphone, published Dec. 2018, https://web.archive.org/web/20181217012503/https://en.wikipedia.org/wiki/Microphone (Year: 2018).*
Wikipedia, Pendulum Music, published Mar. 2017, https://web.archive.org/web/20170305060119/https://en.wikipedia.org/wiki/Pendulum_Music (Year: 2017).*
Ester RasetArmengol, Swinging Robot, published Jan. 2016, https://www.youtube.com/watch?v=jG1qt5XmJaU (Year: 2016).*
TheFloopTube, Swinging Robot, published Jan. 2017, https://www.youtube.com/watch?v=1dJm3CUGpbE (Year: 2017).*
Pranav Bhounsule, Physics Demonstration: Dancing Pendulums, published Dec. 2015, https://www.youtube.com/watch?v=ZTBn79uAvYQ (Year: 2015).*

* cited by examiner

*Primary Examiner* — Mark Fischer
(74) *Attorney, Agent, or Firm* — James M. Kasischke; Michael P. Stanley

(57) ABSTRACT

An acoustic source positionable on a platform in an operating environment includes a pendulum arm and a trans-
(Continued)

ducer positioned on the pendulum arm. The combined arm and transducer have a natural frequency of oscillation dictated by gravity and a pendulum length. A signal generator is electrically joined to the transducer. The signal generator has a preferred frequency of operation at the natural frequency of the pendulum.

11 Claims, 3 Drawing Sheets

COMPACT LOW-FREQUENCY ACOUSTIC SOURCE

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND

(1) Field of the Invention

The present invention is directed to an acoustic source and more particularly a compact, low-frequency acoustic source.

(2) Description of the Prior Art

A practical acoustic source at low frequencies is difficult to achieve because it can get very large. Low frequencies are those below 100 Hz and down to 4 Hz. A conventional resonant acoustic source (e.g., a Tonpilz transducer) is small compared to the wavelength that it radiates, so its effective mass m and stiffness k can be modeled as lumped elements. Although a moving coil source (similar to that used to drive loudspeakers) can in principle transmit acoustic energy at any frequency or bandwidth (in response to an input signal), its non-resonant nature makes it less efficient than a resonant source, limiting its applicability.

Low frequency acoustic sources have large physical dimensions in order to create the long acoustic wavelengths associated with low frequencies. One such transducer has a height of 0.5 m and a 0.5 m diameter. This transducer is limited to a low frequency of 20 Hz.

Transducers operate at or near their resonant frequency, i.e., $\omega=2\pi f=\sqrt{k/m}$ for efficient operation. ω is the angular frequency, f is the frequency, k is the force constant, and m is the mass. The resonant frequency can be reduced by lowering the force constant k or increasing mass m or by some combination of these. In practice, a transducer resonating at 5 Hz (for example) becomes prohibitively large and heavy. Lowering k usually involves increasing the effective transducer length scale. A transducer can be modeled as a spring/mass system (driven by electrical components representing the piezoelectric elements), so reducing the effective spring constant k by one half will involve doubling the spring length, all other parameters being equal.

It is usually not practical to achieve a low resonant frequency by reducing k instead of increasing m. Since $\omega=\sqrt{k/m}$, ω can be small (in principle) even if both k and m are small, since only their ratio k/m is relevant. In any case, this leads to an overdamped system, which occurs when $$\frac{c_M}{2\sqrt{km}} > 1 \tag{1}$$

Here $c_M$ is the effective mechanical damping of the system, which includes the effects of energy lost as a result of acoustic radiation. The goal of transducer designs is maximizing the acoustic radiation.

Even if the system is not overdamped, a small effective spring constant k would lead to a highly compliant transducer structure that would have difficulty surviving the hydrostatic pressure and other forces associated with its operation.

A pendulum has period T defined as follows:

$$T=2\pi\sqrt{L/g} \tag{2}$$

where L is the pendulum length and $g=9.81\ m/s^2$. Thus, a pendulum having length L of 1 cm will have a period of 0.2 seconds and a frequency of approximately 5 Hz. (In water the frequency will be slightly lower because of the effect of the added mass associated with the water.) The pendulum period T is approximately constant over a wide range of angular displacements. It is thus desirable to adapt pendulum dynamics for use as an acoustic source.

SUMMARY

It is a first object of the present invention to provide a low frequency acoustic source.

Another object is to provide such a source that is more compact than existing sources.

Accordingly, there is provided an acoustic source positionable on a platform in an operating environment, e.g., air or water. The source includes a pendulum arm and a transducer positioned on the pendulum arm. The combined arm and transducer have a natural frequency of oscillation dictated by gravity and a pendulum length. A signal generator is electrically joined to the transducer. The signal generator has a preferred frequency of operation at the natural frequency of the pendulum.

An array of acoustic sources can be provided to transmit signals at a higher power level. Time delays can be used with each of the acoustic sources to allow beamformed transmissions. The array of acoustic sources can be either a narrowband acoustic source or a broadband acoustic source by specifying different pendulum lengths and signal generator frequencies.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
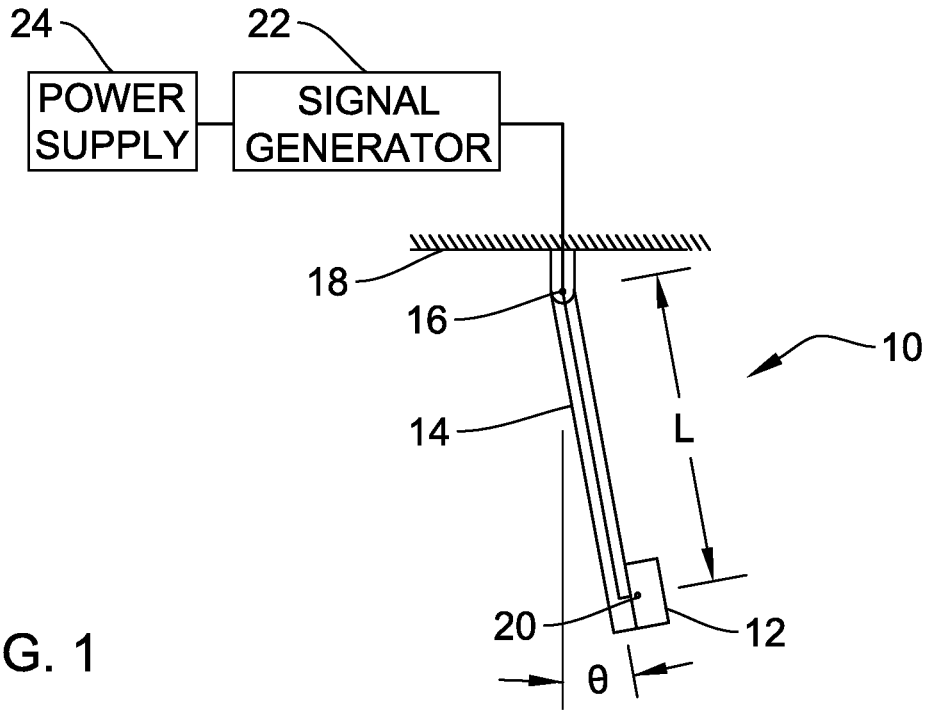
FIG. 1 is a diagram of a first embodiment.

Referring to FIG. 1, there is shown a pendulum 10 having an acoustic source 12 mounted at the distal end of a pendulum arm 14. Pendulum arm 14 is joined to a pivot 16 mounted to a platform 18. Pendulum 10 has a length L between pivot 16 and a center of mass 20 of pendulum 10. On application of a force, pendulum 10 can swing through an angle θ. Pendulum arm 14 can be a rigid rod or a line held under tension by gravity. Various schemes exist for providing temperature compensation for pendulum arms. Pivot 16 can support a single degree of freedom allowing the pendulum arm to swing in a single plane or multiple degrees of freedom allowing the pendulum arm to swing in multiple planes.

Source 12 is electrically joined to a signal generator 22 which is powered by a power supply 24. The pendulum arm 14 and source 12 entire system will resonate at a predetermined pendulum frequency if source 12 has a dipole component to it. Signal generator 22 and power supply 24 can be positioned on platform 24, as shown, or can be positioned on pendulum arm 14 proximate source 12.

Source 12 can be made from many different types of transducers. Preferably, source 12 is made from a composite or crystalline piezoelectric material. Piezoelectric materials can be poled along the axis of the piezoelectric displacement or transverse to the axis. Source 12 can also be made from magnetic coil transducers (e.g., loudspeakers when the apparatus operates in air) or from other known transducer types.

Figure 2:
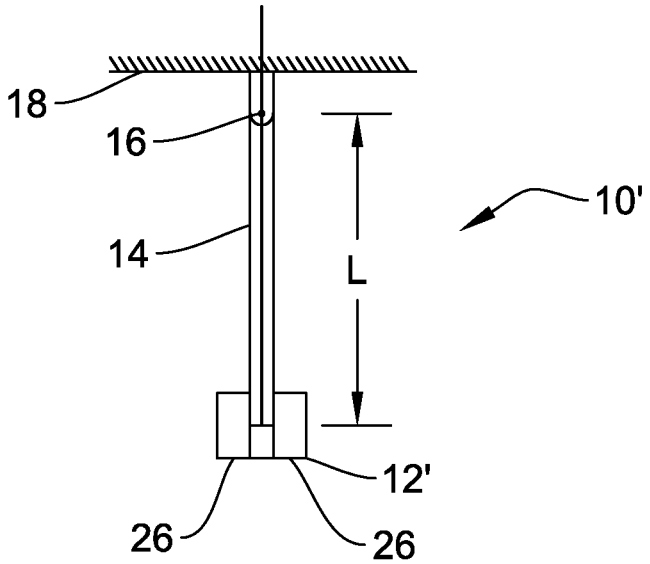
FIG. 2 is a diagram of an alternate embodiment.

FIG. 2 shows an alternative embodiment having an enhanced dipole nature. Source 12' is made from two transducer elements 26 mounted on either side of pendulum arm 14. Transducer elements 26 are joined to signal generator 22 so that they operate out of phase with one another. Preferably, the transducer elements should be 180 degrees out of phase with each other.

Figure 3:
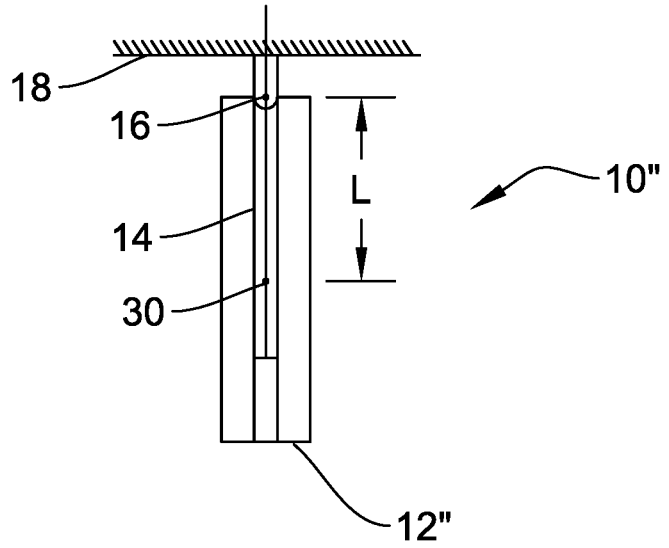
FIG. 3 is a diagram showing another alternative embodiment.

FIG. 3 provides an additional embodiment having larger transducer elements 28 making up source 12" positioned on either side of pendulum arm 14. Utilizing equation (2), pendulum length L for operation at 5 Hz is only 1 cm. Elements 28 have approximately the same length as the pendulum arm 14. In this case, the center of mass 30 defines the pendulum length L. In this embodiment, pendulum 10" would have a length of 2 cm for a 5 Hz operation.

A device of this nature could not act as a directional source because diffraction of the acoustic field will quickly convert the dipole radiation pattern to a monopole pattern. However, the dipole component of the two transducer elements will act to push the pendulum back and forth at its natural frequency. The actual acoustic particle displacement due to the dipole source will be very low. (This is generally true of the acoustic particle displacement associated with any acoustic source. One of the key properties of the pendulum is that its period is independent of the angular displacement θ when θ is small (in the sense that $\sin\theta \approx \theta$).

Figure 4:
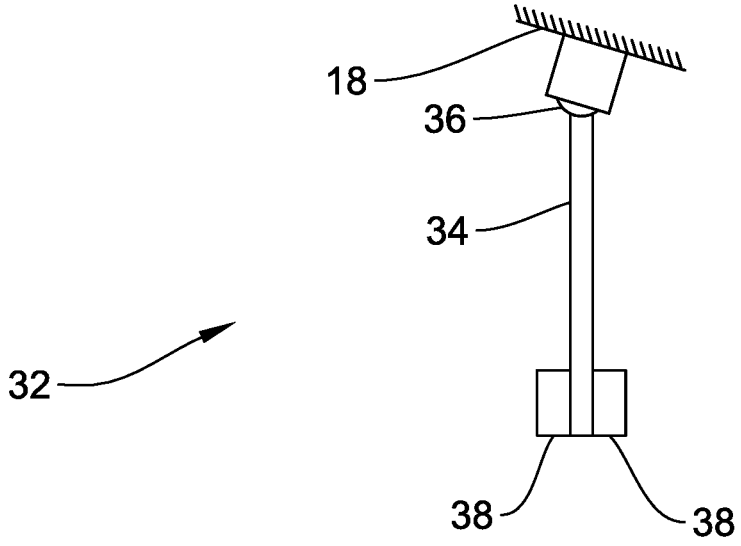
FIG. 4 is a diagram showing an alternate embodiment allowing platform tilt.

FIG. 4 shows another alternate embodiment 32 in which the pendulum arm 34 is attached by a ball joint 36 to allow the pendulum arm 34 to swing in multiple planes. Transducer elements 38 are provided on two sides of pendulum arm 34. Elements 38 are joined to a signal generator (not shown) as in the other embodiments. Use of ball joint 36 allows canting of platform 18 in any direction. Other joints, such as a flexible member, allowing multi-plane movement of pendulum can be used in place of ball joint 36.

Figure 5:
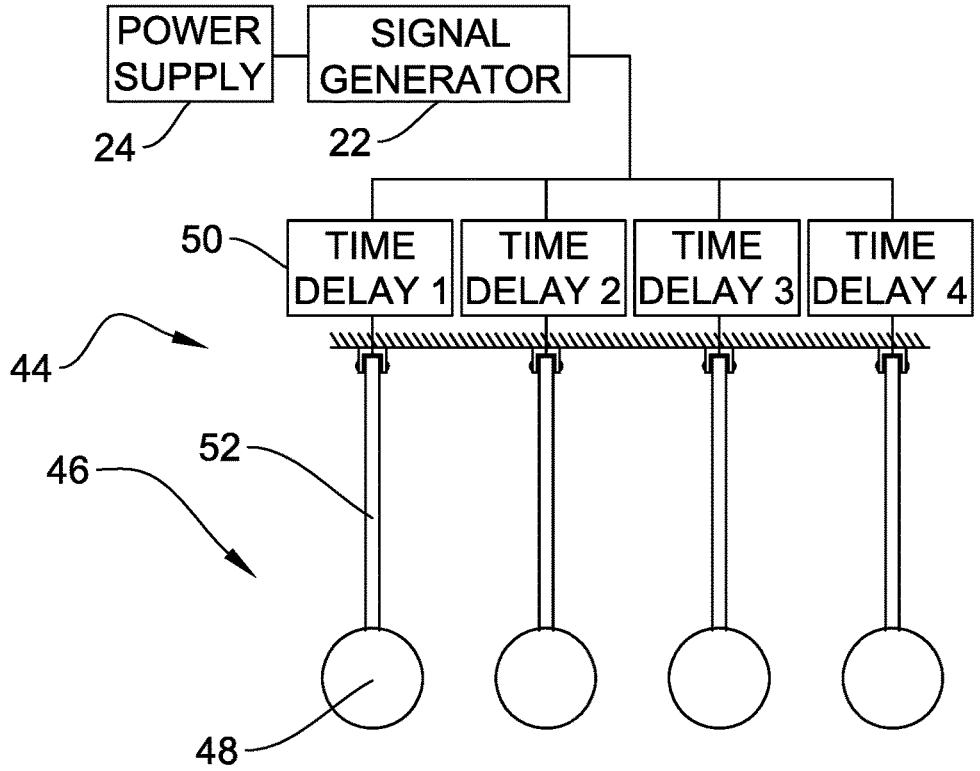
FIG. 5 is a diagram showing an embodiment utilizing an array of acoustic sources for narrowband transmission.

FIG. 5 shows an embodiment 44 providing an array 46 of transducers 48. A single transducer on a pendulum arm may produce an insufficient source level. In order to remedy this, an array 46 of transducers 48 is needed to generate a higher source level. Each transducer is positioned on a pendulum arm 50. Pendulum arm 50 is joined to a pivot 16. In FIG. 5, transducers 48 and pivot arms 50 are positioned such that the combination swings in a plane that is perpendicular to page.

Figure 6:
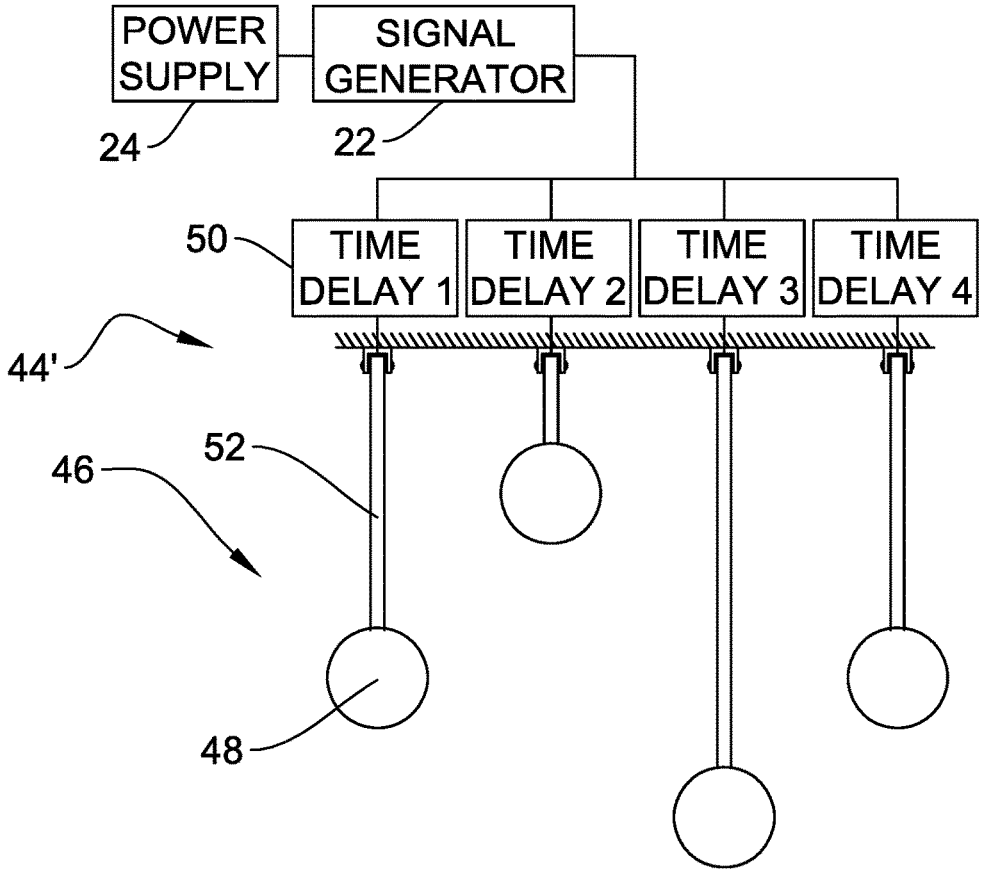
FIG. 6 is a diagram showing an alternative embodiment utilizing an array of acoustic sources for broadband transmission.

In embodiment 44, the signals from signal generator 22 to each transducer 48 should be synchronized. Time delays 50 such as time delay 1, shown as reference number 50, can be used to beamform the transmitted signal by delaying the signals provided by some transducers relative to those provided by others in order that the transmissions arrive at the same time at a target angle. This array 46 of transducers 48 on pendulum arms 52 having the same length will produce a narrowband transmit signal. FIG. 6 provides an alternate embodiment 44' as an array 46 of transducers 48 having pendulum arms 52 with varying lengths to produce a broadband signal. In the broadband embodiment, signal generator 22 can provide a broadband signal that is effectively filtered by the pendulum response. Alternatively, a plurality of signal generators can be provided having different frequencies. Each signal generator could be associated with a different length pendulum arm. As before, a time delay 50 could be used for beamforming. Embodiments 44 and 44' make it possible to put a large number of such pendulums into a small package. A larger pendulum, e.g., having a length of 0.5 meters, will have a lower frequency (approximately 0.7 Hz) and would be large enough that a single transducer can generate significant source level.

This low frequency source makes use of pendulum dynamics instead of spring-mass dynamics to achieve mechanical resonance at the transducer operational frequency. Utilizing this type of low frequency source results in source sizes that are an order of magnitude smaller than conventional resonant transducers operating at very low frequencies.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. An acoustic source positionable on a platform in an operating environment comprising:

a pendulum arm pivotally attached to said platform at a first end and having a distal end away from and below the platform;

an acoustic transducer positioned on said pendulum arm, said combined acoustic transducer and pendulum arm having a natural frequency of oscillation dictated by gravity and a distance from said pendulum arm first end to a center of gravity of said combined acoustic transducer and pendulum arm; and a signal generator electrically joined to said acoustic transducer to provide an output signal to said acoustic transducer, said signal generator having a maximum acoustic output frequency of operation at the natural frequency of the combined acoustic transducer and pendulum arm in the operating environment.

2. The apparatus of claim 1, wherein said acoustic transducer comprises at least two acoustic transducers positioned on opposite sides of said pendulum arm.

3. The apparatus of claim 2, wherein said two acoustic transducers are joined to said signal generator to operate out of phase with each other.

4. The apparatus of claim 2, wherein said two acoustic transducers are joined to said signal generator to operate 180 degrees out of phase with each other.

5. The apparatus of claim 1, wherein said pendulum arm pivotal attachment to the platform allows said pendulum arm to pivot in multiple planes.

6. The apparatus of claim 1, wherein said acoustic transducer is made from a piezoelectric material.

7. The apparatus of claim 1, wherein said acoustic transducer is made from a magnet and coil device.

8. An acoustic source positionable on a platform in an operating environment comprising:

a pendulum arm pivotally attached to said platform at a first end and having a distal end away from and below the platform;

at least two acoustic transducers positioned on opposite sides of said pendulum arm wherein said at least two acoustic transducers extend from the first end of said pendulum arm to the distal end of said pendulum arm, said combined acoustic transducers and pendulum arm having a natural frequency of oscillation dictated by gravity and a distance from said pendulum arm first end to a center of gravity of said combined acoustic transducers and pendulum arm; and a signal generator electrically joined to said acoustic transducers, said signal generator having a maximum acoustic output frequency of operation at the natural frequency of the combined acoustic transducers and pendulum arm in the operating environment.

9. An acoustic source positionable on a platform in an operating environment comprising:

a plurality of pendulum arms, each pivotally attached to the platform at a first end and having a distal end away from and below the platform;

a plurality of acoustic transducers with at least one acoustic transducer positioned on each said pendulum arm, said combined transducer and pendulum arm having a natural frequency of oscillation dictated by gravity and a distance from said pendulum arm first end to a center of gravity of said combined acoustic transducer and pendulum arm;

a signal generator electrically joined to each said acoustic transducer, said signal generator having a maximum acoustic output frequency of operation at the natural frequency of the combined acoustic transducer and pendulum arm in the operating environment; and a plurality of controllable time delays in connection between said plurality of acoustic transducers and said signal generator, each of said controllable time delays being controllable in coordination with others of said controllable time delays to result in beamformed acoustic output from the acoustic source.

10. The apparatus of claim 9, wherein pendulum arms of said plurality of pendulum arms have different distances from said pendulum arm first end to the center of gravity of said combined acoustic transducer and pendulum arm.

11. The apparatus of claim 10, wherein said signal generator has a plurality of maximum acoustic output frequencies of operation associated with the natural frequency of each of the combined acoustic transducer and pendulum arms in the operating environment.

* * * * *